United States Patent [19]

Chang

[11] Patent Number: 4,707,884

[45] Date of Patent: Nov. 24, 1987

[54] FOLDABLE HANDLE FOR A SKATEBOARD

[76] Inventor: San T. Chang, 82, Lane 145, San Ho Rd., sec. 4, San Chang City, Taipei Hsien, Taiwan

[21] Appl. No.: 871,368

[22] Filed: Jun. 6, 1986

[51] Int. Cl.[4] ..... B25G 1/04

[52] U.S. Cl. ..... 16/113; 16/325; 16/341; 16/346; 280/87.04 R; 403/95

[58] Field of Search ..... 16/112, 113, 115, 126, 16/324, 325, 333, 337, 341, 346, 347, 349; 280/87.04 R, 87.04 A, 87.05; 220/94 R; 403/95, 98, 103

[56] References Cited

U.S. PATENT DOCUMENTS

| | | | |
|---|---|---|---|
| 1,070,468 | 8/1913 | Henley | 280/87.04 R |
| 1,387,675 | 8/1921 | Worobow | 280/87.04 R |
| 4,121,605 | 10/1978 | Schmerl | 403/95 X |

*Primary Examiner*—Fred Silverberg

*Attorney, Agent, or Firm*—Kirschstein, Kirschstein, Ottinger & Israel

[57] ABSTRACT

A foldable handle for skateboard includes a base plate adapted to be fixed on a base board of a skateboard; two opposed upright plates, fixed on the base plate and spaced apart from each other; a handle, pivoted between the upright plates, and which does not contact the base plate; a gripping mechanism for gripping releasably the handle, disposed between the upright plates along a side of the handle; and a block member, fixed between the upright plates along an opposite side of the handle from the gripping mechanism for blocking the handle; thereby, when the gripping mechanism is released, the handle is foldable to rest transversely on the base board of the skateboard from an operative position. Furthermore, the foldable handle can be used with the skateboard for exercise as soon as it is restored to the operative position.

8 Claims, 5 Drawing Figures

FOLDABLE HANDLE FOR A SKATEBOARD

BACKGROUND OF THE INVENTION

The invention relates to a handle for a skateboard, particularly to a foldable handle for a skateboard.

Skateboards have been popular among young people for many years. During the use of such a skateboard, since the user must stand on the base board of the skateboard with one foot and propel himself with the other, he must exercise extreme skill in maintaining his balance. This is dangerous for beginners and children. A skateboard with a handle screwed to the base board has been developed to reduce the danger. However, when such a handle is assembled with the base board, it is inconvenient to transport and to store. Although, it may be disassembled with the base board to transport or store, it takes a relatively large amount of time because of the need to screw and unscrew a number of screws.

SUMMARY OF THE INVENTION

An object of the invention is to provide a holdable handle for a skateboard, which is foldable by a simple operation to rest transversely on the base board of the skateboard from an operative position. Subsequently, the handle can be used with the skateboard for exercise as soon as it is restored to the operative position.

According to the invention, a holdable handle includes a base plate, adapted to be fixed on a base board of a skateboard; two opposed upright plates, fixed on said base plate and spaced apart from each other at a predetermined distance; a handle, pivoted between said two upright plates, and which does not contact said base plate at a lower end portion thereof; a gripping mechanism for gripping releasably said handle, disposed between said two upright plates along a side of said handle, including a gripping element pivoted between said two upright plates, and a resilient member biasing said gripping element upwardly to grip said lower end portion of said handle; and a block member, fixed between said two upright plates along an opposite side of said handle from said gripping element so that, said block member, said two upright plates and said gripping mechanism surround closely and locate said lower end portion of said handle in position; whereby, when said gripping element is moved downward against said resilient member to disconnect with said lower end portion of said handle, permitting said handle to be folded to rest transversely on said base board of said skateboard.

DETAILED DESCRIPTION OF THE PREFERRED EMBODIMENTS

Figure 1:
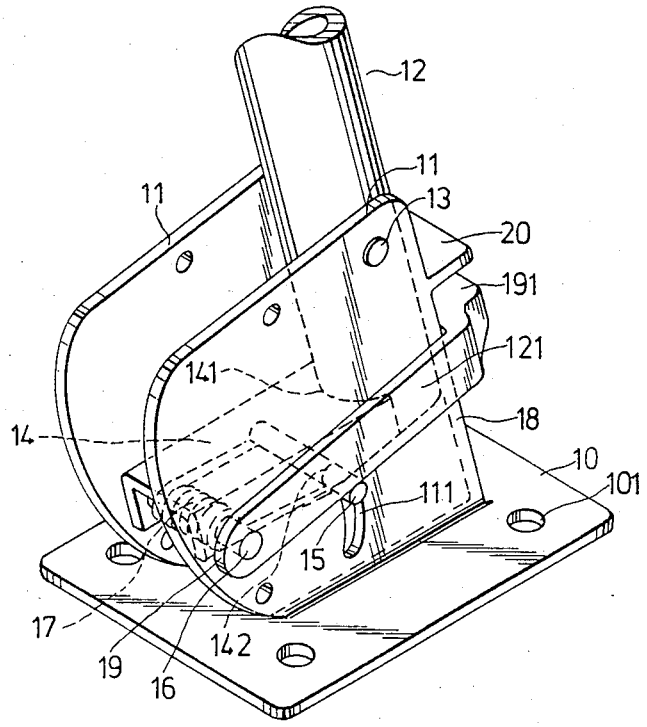
FIG. 1 is a perspective view showing a lower portion of a foldable handle for a skateboard according to the invention.

Referring to FIG. 1, there is shown a lower portion of a foldable handle for a skateboard according to the invention, which includes a rectangular base plate 10 with four circular holes 101 for fixing the base plate 10 on the skateboard; two opposed upright plates 11 of a same size, fixed on the base plate 10, spaced apart from each other at a predetermined distance and in parallel with each other, each having a curved guide slot 111, the two guide slots 111 being directly opposed; a handle 12, pivoted between the two upright plates 11 by a first pivot pin 13, and not contacting the base plate at a lower end portion 121 thereof; a gripping mechanism, disposed between the two upright plates 11 along a side of the handle 12 (left side of FIG. 1), including a gripping plate 14 which is provided with a concave curved end edge 141 for gripping the lower end portion 121 of the handle 12 and a through bore 142, a sliding rod 15 being inserted securely through the through bore 142 at an intermediate portion of the slilding rod 15 and inserted through the two guide slots 111 at two end portions of the sliding rod 15 so the sliding rod 15 is slidable upwardly and downwardly within the two guide slots 111, a second pivot pin 16 connected to the two upright plates 11, and a torsion spring 17, surrounding the second pivot pin 16 for biasing the concave curved end edge 141 of the gripping plate 14 upwardly to grip the lower end portion 121 of the handle 12; a block plate 18 connected securely to the two upright plates 11 along an opposite side of the handle 12 from the gripping mechanism (right side of FIG. 1), so that the block plate 18, the two upright plates 11 and the gripping plate 14 surround closely and locate the lower end portion 121 of the handle 12 in position; a generally U-shaped control lever 19, pivoted on the two upright plates 11 at two ends of the control lever 19 by the second pivot pin 16, contacting an upper portion of the sliding rod 15 at an intermediate portion thereof so that an enlarged control portion 191 of the control lever 19 can control the sliding rod 15 to move within the slots 111 and a guard plate 20, secured to the two upright plates 11 above the control portion 191 of the control lever 19 for preventing the handle from moving due to a clumsy movement of the user knocking the control portion 191.

Figure 2:
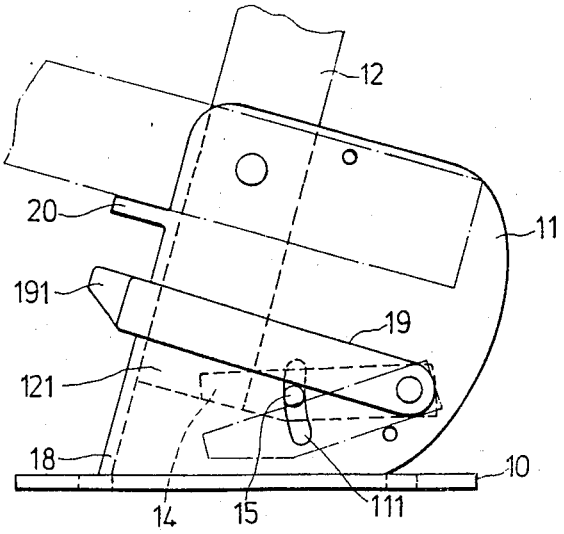
FIG. 2 is a schematic view showing the operation before folding of the handle of FIG. 1.
Figure 3:
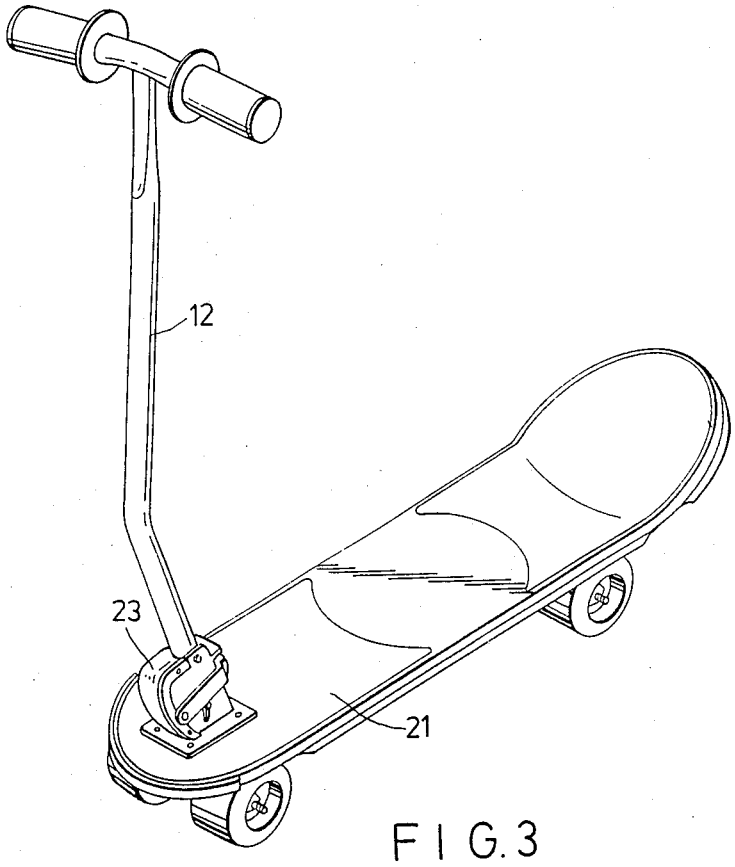
FIG. 3 is a schematic view showing the handle of FIG. 1 in use.
Figure 4:
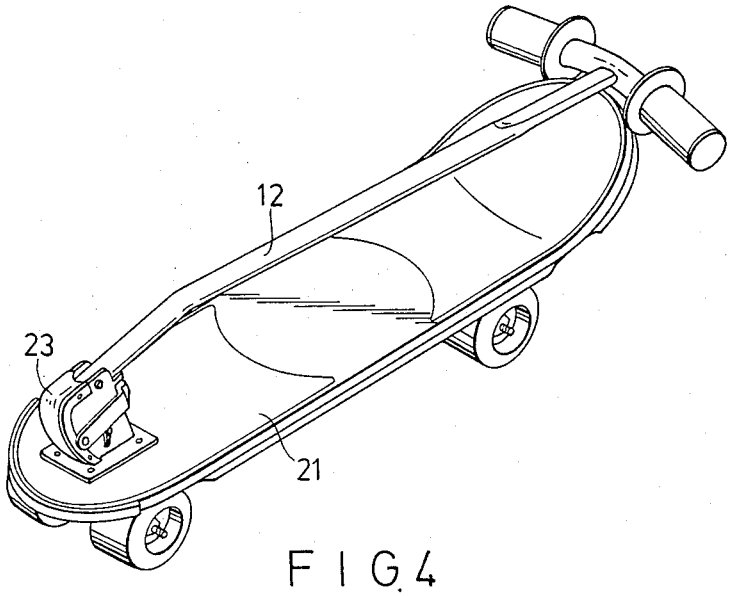
FIG. 4 is a schematic view showing the handle of FIG. 1 in a folded condition.

In use, referring to FIG. 3, the handle 12 in an operative condition is generally perpendicular to the base board 12 of the skateboard. When it is desired to transport or store the skateboard, the user may depress the control portion 191 of the control lever 19 so that the sliding rod 15 is moved downward and hence the concave curved end edge 141 of gripping plate 14 is moved to disconnect with the lower end portion 121 of the handle 12, as shown by the phantom line of FIG. 2. Then, because of the release of the gripping plate, the handle 12 is foldable to rest transversely on the base board 21, as shown in FIG. 4. This is a simple arrangement and it renders the skateboard very convenient to transport and to store. Subsequently, when the handle 12 is restored to the position of FIG. 4, by being lifted the lower end portion 121 of the handle 12 will be blocked by the block plate 18 and be gripped by the gripping plate 14 due to the restoring force of the torsion spring 17. Accordingly, the handle 12 can be used with the skateboard for exercise as soon as the handle 12 resting on the base board 21 is pulled upward about the first pivot pin 13 to the operative position of FIG. 4.

Figure 5:
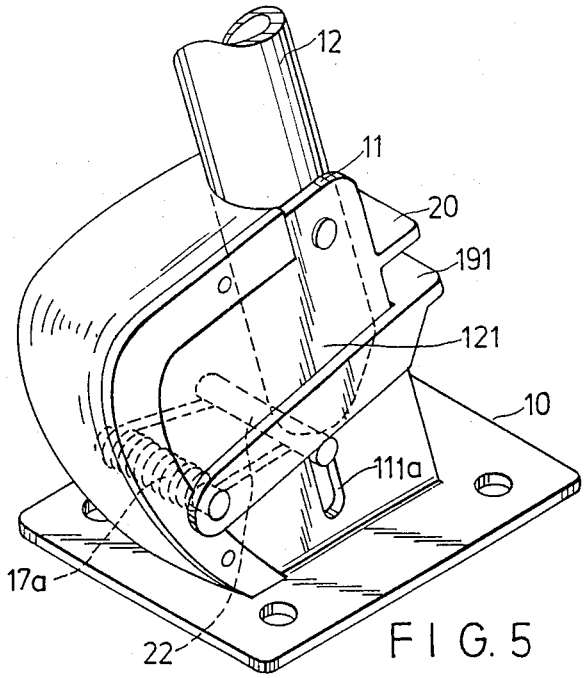
FIG. 5 is a perspective view showing a lower portion of another handle for a skateboard according to the invention.

Alternatively, referring to FIG. 5, each of the upright plates can have a longitudinal straight guide slot 111*a* near the handle 12, and the gripping mechanism is constructed of a gripping rod 22 and a torsion spring 17*a*.

The gripping rod 22 is inserted through the two straight guide slots 111*a*, and the torsion spring 17*a* connects securely to the gripping rod 22 and biases the gripping rod 22 upwardly to grip the lower end portion 121 of the handle 12.

It should be appreciated that the lower end portion 121 of the handle 12 may be provided with a cutting plane (not shown) opposing the gripping rod 22 to facilitate the lower end portion 121 being gripped confirmly by the gripping rod 22.

In addition, as shown in FIG. 3, above the gripping mechanism may be also provided a guard cover 23 to protect the gripping mechanism and to improve the appearance of the handle.

With the invention thus explained, it is apparent that various modifications and variations can be made without departing from the scope of the invention. It is therefore intended that the invention be limited as indicated in the appended claims.

What is claimed is:

1. A foldable handle for a skateboard comprising:

a base plate adapted to be fixed on a base board of a skateboard;

two opposed upright plates, fixed on said base plate and spaced apart from each other at a predetermined distance;

a handle, pivoted between said two upright plates, and which does not contact said base plate at a lower end portion of the handle;

a gripping mechanism, disposed between said two upright plates along a side of said handle, including a gripping element pivoted between said two upright plates, and a resilient member biasing said gripping element upwardly to grip said lower end portion of said handle; and a block member, fixed between said two upright plates along an opposite side of said handle from said gripping mechanism so that, said block member, said two upright plates and said gripping mechanism surround closely and locate said lower end portion of said handle in position;

whereby, when said gripping element is moved downward against said resilient member to disconnect with said lower end portion of said handle, said handle is capable of being folded to rest on said base board of said skateboard.

2. A foldable handle for a skateboard as claiimed in claim 1, wherein each of said upright plates includes a longitudinal side slot having a predetermined length, said two guide slots being directly opposed, and wherein said gripping mechanism comprises:

the gripping element being pivoted between said two upright plates at an end of sad gripping element;

the gripping element, gripping said handle with a free end edge of said gripping element; and a sliding rod, secured to an intermediate portion of said gripping element, and inserted through said two guide slots at two end portions of the sliding rod so that said sliding rod is slidable upwardly and downwardly within said two guide slots for being controlled.

3. A foldable handle for a skateboard as claimed in claim 2, further comprising a control lever pivoted on said upright plates at an end thereof and capable of contacting an upper portion of said sliding rod at an intermediate portion of said control lever for moving said slidable rod downward to disconnect said free end edge of said gripping element from said lower end portion of said handle.

4. A foldable handle for a skateboard as claimed in claim 2, wherein said free end edge of said gripping element is a concave curved edge for easily gripping said handle.

5. A foldable handle for a skateboard as claimed in claim 2, further comprising a guard cover mounted on said upright plates above said gripping mechanism for protecting said gripping mechanism.

6. A foldable handle for a skateboard as claimed in claim 1, wherein each of said upright plates includes a longitudinal guide slot having a predetermined length, said two guide slots being directed opposed, and near said lower end portion of said handle, and wherein said gripping element comprises:

a gripping rod, pivoted between said two upright plates and inserted through said two guide slots at two end portions of the gripping rod so that it is slidable upwardly and downwardly within said two guide slots.

7. A foldable handle for a skateboard as claimed in claim 6, further comprising a control lever pivoted on said upright plates at an end thereof and capable of contacting an upper portion of said gripping rod at an intermediate portion of the control lever for moving said gripping rod downwardly to disconnect from said lower end portion of said handle.

8. A foldable handle for a skateboard as claimed in claim 6, further comprising a guard cover mounted on said upright plates above said gripping mechanism for protecting said gripping mechanism.

* * * * *